US005605244A

United States Patent [19]

Bradshaw

[11] Patent Number: 5,605,244

[45] Date of Patent: Feb. 25, 1997

[54] PLASTIC CONTAINER WITH CLOSURE LOCKING MECHANISM

[75] Inventor: T. Gary Bradshaw, El Dorado, Ark.

[73] Assignee: Lobo Containers, Inc., El Dorado, Ark.

[21] Appl. No.: 362,253

[22] Filed: Dec. 22, 1994

[51] Int. Cl.[6] ..... B65D 45/32

[52] U.S. Cl. ..... 220/320; 220/319; 220/298; 220/300

[58] Field of Search ..... 220/320, 300, 220/293, 306, 307, 298, 308, 319, 321; 215/222

[56] References Cited

U.S. PATENT DOCUMENTS

| | | | |
|---|---|---|---|
| 2,663,450 | 12/1953 | Bourcart | 220/300 |
| 2,679,878 | 6/1954 | Stine | 220/300 |
| 3,204,811 | 9/1965 | Fine | 220/320 |
| 3,438,538 | 4/1969 | Peters | 220/39 |
| 3,447,825 | 6/1969 | Santoni | 220/320 X |
| 3,815,777 | 6/1974 | Churan | 220/308 X |
| 3,888,383 | 6/1975 | Rowlands | 220/293 X |
| 4,014,452 | 3/1977 | Galer | 220/74 |
| 4,245,753 | 1/1981 | Ellis | 220/308 X |
| 4,386,715 | 6/1983 | Morton | 220/306 X |
| 4,429,805 | 2/1984 | Letica | 220/306 |
| 4,453,647 | 6/1984 | Neat . | |
| 4,711,364 | 12/1987 | Letica | 220/306 X |
| 5,072,850 | 12/1991 | Gagnon et al. | 220/300 |
| 5,259,526 | 11/1993 | Stolzman | 220/319 X |
| 5,292,024 | 3/1994 | Koefelda et al. | 220/306 X |
| 5,361,928 | 11/1994 | Stolzman | 220/321 X |
| 5,368,182 | 11/1994 | Schutz | 220/308 X |

FOREIGN PATENT DOCUMENTS

| | | |
|---|---|---|
| 1137177 | 5/1957 | France . |
| 843712 | 7/1952 | Germany . |

*Primary Examiner*—Allan N. Shoap
*Assistant Examiner*—Robin A. Hylton
*Attorney, Agent, or Firm*—Carothers & Carothers

[57] ABSTRACT

A blow molded plastic container and lid combination wherein a bayonet type thread lock mechanism is provided between an exterior skirt portion of the lid and an interior side wall portion of the container to secure them together. The lid is further provided with a circumferential perimeter overhang that has an inverted U-shaped rim channel above this bayonet type thread lock mechanism for circumferentially receiving and engaging the top end of the container. An inwardly directed annular shoulder is also provided on the container side wall between this bayonet thread lock mechanism and the top end portion of the container whereby a split ring clamp circumferentially secures the chime area of the lid and container combination in sealed engagement. The split ring clamp has an inwardly open U-shaped channel for engaging this container annular shoulder and also circumferential top portions of the lid to clamp them together in vertical compressed engagement.

6 Claims, 4 Drawing Sheets

PLASTIC CONTAINER WITH CLOSURE LOCKING MECHANISM

BACKGROUND OF THE INVENTION

The present invention pertains to containers or drums for multiple use, including the containment of toxic waste or materials.

Such drum type containers are generally constructed of plastic, such as high density polyethylene, and they are corrosion resistant and have adequate mechanical strength combined with light weight such that they provide a light weight safe containment of hazardous or other materials without leaking, despite rough handling during transportation. Such containers when empty are also constructed to be stackable for space saving considerations.

Generally the plastic molded drums or containers in the range of from three gallon to fifty-five gallon capacity are provided with split ring metal chime clamps to facilitate the attachment of the lid to the container.

For most designs, the split ring clamp is provided with an annular inwardly facing groove that effects a deforming securement of the rim of the lid to the top of the drum wall.

To assure a secured retention of the lid, designs for the lid securing structures are tested. For example, specifications have been provided by a variety of commercial, international and government entities and the United States Department of Transportation (DOT), Research and Special Programs Administration. However, the United Nations has also set specifications which are even more rigorous.

Typically, drop tests are called for by the test procedures wherein samples taken at random are filled with dry finely powdered or liquid material to an authorize net weight and closed as for use. The containers so filled with dry powder or water, must withstand drop tests of varying heights upon specified parts without leakage or serious rupture. In one such drop, the top chime is dropped diagonally directly onto solid concrete. In another test, the bottom of the container is dropped diagonally such that the bottom chime contacts solid concrete. The drop test heights vary but generally average from four to six feet.

While drum-lid assemblies including split clamping rings have met the specifications as above required, 100% reliance upon split ring clamping assemblies to hold the lid and drum assemblies together during such drop tests has proven to be inadequate when dealing with the larger drums approaching the 55 gallon or higher drum capacity range.

It is a principal object of the present invention to provide such a lid and drum combination, which further utilizes a metal or plastic split ring clamp assembly, that will not be prone to failure in such drop tests.

SUMMARY OF THE INVENTION

In the container and closure combination of the present invention, the container is provided with a tubular side wall having top and bottom ends and an interior and exterior surface. In addition, the container is further provided with a circular bottom wall.

The lid is provided with a downwardly depending circumferential skirt that has an exterior surface. Locking threads are provided on the interior surface of the container sidewall adjacent the top end and also on the exterior surface of the lid skirt for mating thread locking engagement with each other to secure the lid to the top end of the container or drum.

The lid is further provided with a circumferential perimeter overhang that provides an inverted U-shaped rim channel above this thread lock mechanism for circumferentially receiving and engaging the top end of the container when the lid is secured onto the container.

An inwardly directed annular shoulder is further provided on the container sidewall. It is provided between the locking threads thereon and the top end portion of the container side wall, which is received in the lid inverted U-shaped channel.

A split metal or plastic ring clamp is provided for circumferentially clamping the lid to the container top when they are secured together in threaded engagement. The split ring clamp is provided with an inwardly open U-shaped channel for engaging the aforementioned container annular shoulder in addition to or simultaneously with circumferential top portions of the lid in vertical compressed engagement. This provides a deforming securement of the lid rim to the drum wall in conventional fashion.

The container and lid are preferably molded of high density polyethylene using blow mold techniques. In addition an ultraviolet stabilizer may be added to the high density polyethylene to reduce the deleterious effects of prolonged sun exposure on the container.

The addition of the thread lock mechanism provided between the lid and the container, as positioned on the interior side wall of the container and on the exterior of the lid skirt, below the area of lid rim engagement with the top end of the container where the ring clamp is secured, insures that the lid will not pop off the container in drop tests for the drums of larger capacity.

This thread lock mechanism between the lid and the top end of the container is preferably provided in the form of a bayonet type thread lock. This bayonet thread lock mechanism includes circumferentially spaced sets of mating thread ramps on the container and lid for forcing the lid downwardly against the top end of the container when the lid is secured by bayonet type joining engagement onto the container top. In addition, a conventional annular resilient seal is also provided in the inverted U-shaped channel of the lid rim to provide a leak proof seal.

BRIEF DESCRIPTION OF THE DRAWINGS

Other objects and advantages appear in the following description and claims.

The accompanying drawings show, for the purpose of exemplification, without limiting the invention or claims thereto, certain practical embodiments illustrating the principals of the this invention wherein:

DESCRIPTION OF A PREFERRED EMBODIMENT

Figure 1:
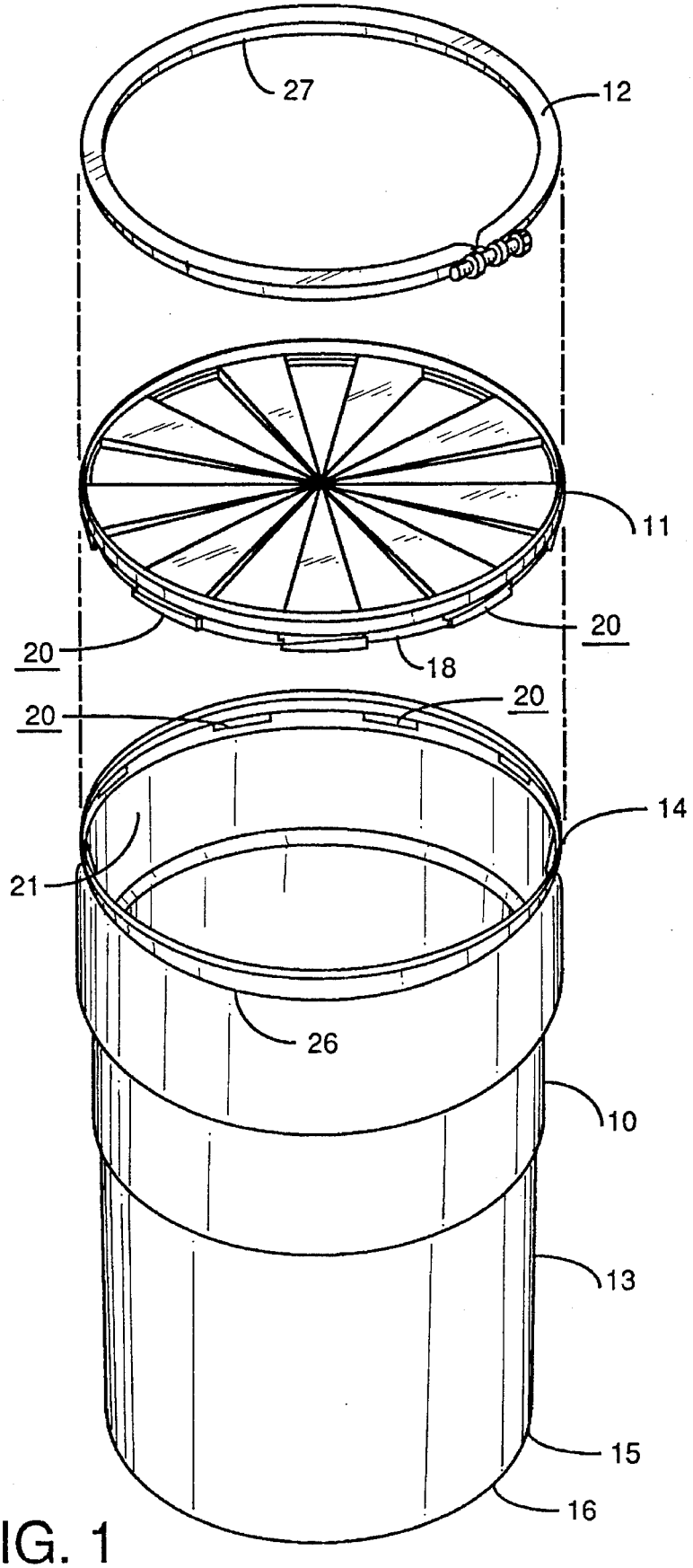
FIG. 1 is an exploded perspective view in side elevation showing the drum or container and lid combination of the present invention, together with a lid retainer split ring clamp.
Figure 2:
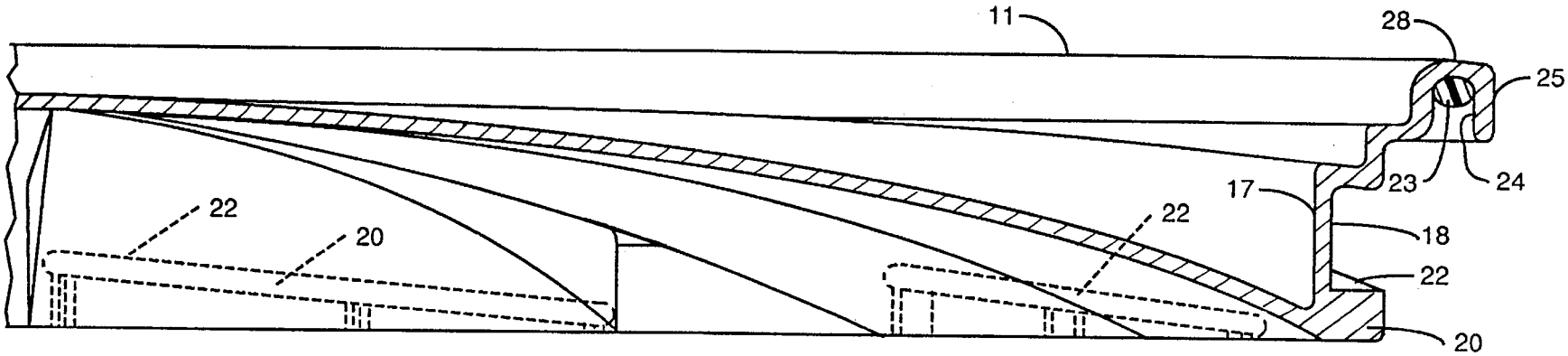
FIG. 2 is a view in vertical mid cross-section of the right side of the container lid shown in FIG. 1.
Figure 3:
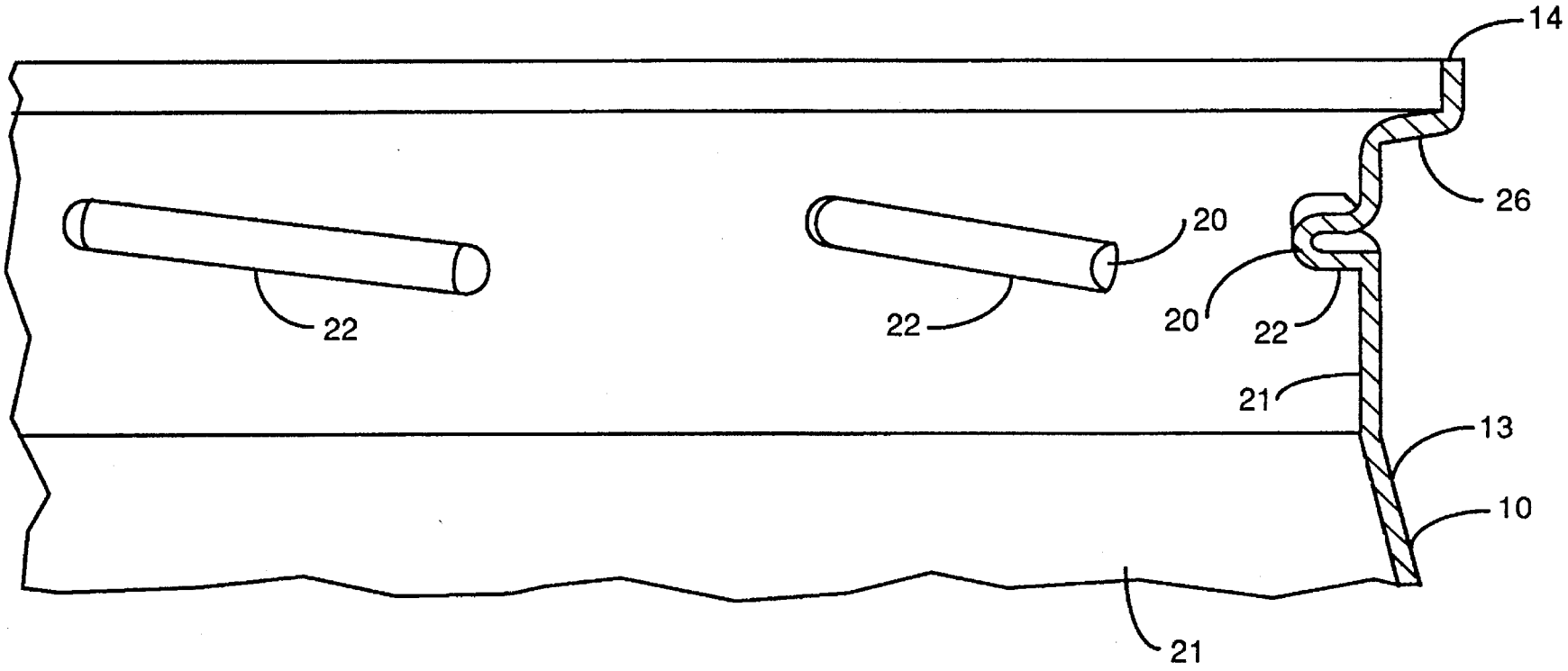
FIG. 3 is a view in vertical mid cross-section of the upper right hand portion of the drum or container shown in FIG. 1.

Referring to FIGS. 1 through 4, the blow molded high density polyethylene container 10 of the present invention is illustrated with lid 11 for closing the top of container 10 and with metal or plastic split ring clamp 12 for circumferentially clamping the chime connection between lid 11 and container 10.

Container 10 has a tubular side wall 13 with a top end 14 and a bottom end 15. The side wall 10 is further provided with a circular bottom wall 16 that closes off the bottom end of the container.

The lid 11 is provided with a downwardly depending circumferential skirt 17 having an exterior surface 18.

A thread lock mechanism 20 in the form of a bayonet type thread locking mechanism is provided on the interior surface 21 of container side wall 13, adjacent top end 14, and also on the exterior surface 18 of lid skirt 17 for mating bayonet thread locking engagement with each other to secure the lid 11 to container 10.

This bayonet type thread lock mechanism 20 includes circumferentially spaced sets of mating thread ramps 22 for forcing lid 11 downwardly on top end 14 of container 10 when lid 11 is secured by clockwise bayonet joint turning engagement on to container 10.

In typical bayonet type thread securing fashion, the lid 11 is placed down on to top end 14 of container 10 such that the circumferentially spaced thread ramps 20 on exterior surface 18 of lid 11 drop or penetrate down between the circumferentially spaced sets of mating thread ramps 20 provided on the interior surface 21 of side wall 13 of container 10. Then the lid 11 is turned clockwise through an angle of approximately 20 degrees such that the lid thread ramps 22 of the lid 11 and upper end 14 of container 10 engage and ride on each other threadably forcing lid 11 downwardly on to the upper end 14 of container 10. This compresses the elastomeric annular seal ring 23 into sealed engagement between the upper end 14 of container 10 and the inside of inverted U-shaped rim channel 24 provided in the circumferential perimeter overhang 25 of lid 11. Thus, the inverted U-shaped channel 24, which is positioned above the thread lock mechanism 20, circumferentially receives and engages the top end of 14 of container 10 in sealed engagement when the lid is secured to the container.

An inwardly directed annular shoulder 26 is provided on container side wall 13 between the locked mechanism 20 and the top end portion 14, which is received in inverted U-shaped channel 24.

Figure 4:
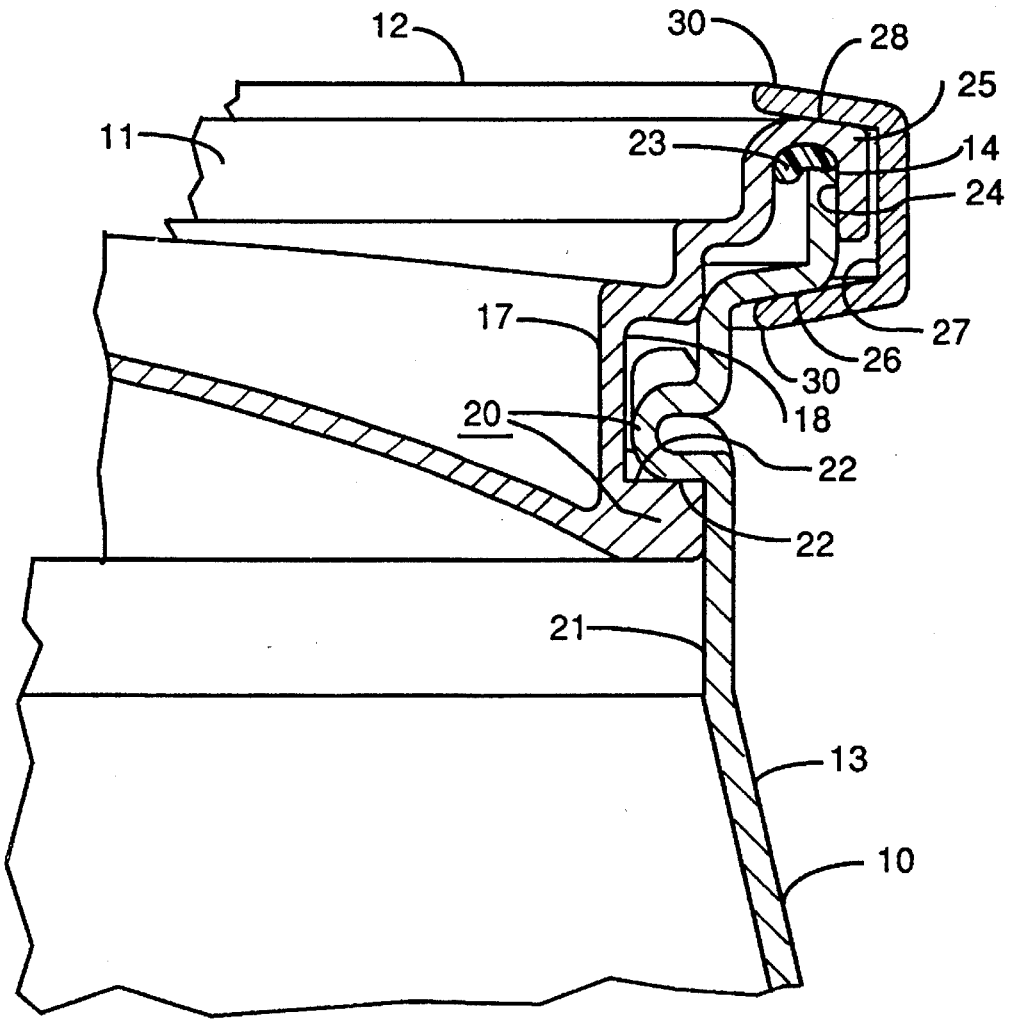
FIG. 4 is a view in vertical mid cross-section of the lid and container sections shown in FIGS. 2 and 3 in combined form showing the lid in sealed securement to the top end of the container in combination with the split ring clamp.

Split ring clamp 12 circumferentially clamps lid 11 to container 10 with a conventional bolt adjustment when they are secured together as best illustrated in FIG. 4. Split ring clamp 12 has an inwardly open U-shaped channel 27 which engages the container annular shoulder 26 and also circumferential top portions 28 of lid 11 between the top and bottom flanges 30 of split ring clamp 12 to vertically compress them together in engagement.

The container 10 and lid 11 are both molded of high density polyethylene utilizing blow molding techniques. In addition, an ultraviolet stabilizer is contained in the high density polyethylene to make the container further resistant to prolonged exposure to the sun's rays.

I claim:

1. A molded container and closure combination comprising: a container having a tubular side wall with top and bottom ends and interior and exterior surfaces and a circular bottom wall, said tubular side wall having a neck portion located below and adjacent said top end, a circular closure lid for said container having a central panel and a skirt extending upwardly from adjacent the periphery of said central panel, said skirt having an exterior surface, thread lock means on the interior surface of said container side wall adjacent said top end and on the exterior surface of said lid skirt for mating thread locking engagement with each other to secure said closure lid at said neck portion, a circumferential perimeter overhang on said closure lid extending radially outwardly from said skirt and providing an inverted annular U-shaped rim channel above and outside of said thread lock means for circumferentially receiving and engaging said top end of said container when said closure lid is secured to said container, said skirt located radially inwardly of said inverted U-shaped annular rim channel, a downwardly facing annular shoulder on the exterior surface of said container side wall positioned between said thread lock means and said top end thereof, and located radially outwardly of said neck portion, said top end terminating in the form of an upwardly facing edge annularly receivable in said closure lid inverted U-shaped channel, and split ring clamp means for circumferentially clamping said closure lid to said container when secured together, said clamp means having an inwardly open U-shaped channel for engaging said container annular shoulder and circumferential top portions of said lid in vertical compressed engagement for compressing said container top edge into said closure inverted U-shaped channel.

2. The molded container and closure combination of claim 1 wherein they are composed of blow molded high density polyethylene.

3. The molded container and closure combination of claim 2 wherein said high density polyethylene includes an ultraviolet stabilizer.

4. The molded container and closure combination of claim 1 wherein said thread lock means is a bayonet type thread lock.

5. The molded container and closure combination of claim 4 wherein said bayonet thread lock means includes circumferentially spaced sets of mating threads.

6. The molded container and closure combination of claim 5 including an annular seal provided in said lid inverted U-shaped channel.

* * * * *